US006782795B2

(12) United States Patent
Olsson

(10) Patent No.: US 6,782,795 B2
(45) Date of Patent: Aug. 31, 2004

(54) HYDRAULIC PERCUSSION/PRESSING DEVICE

(75) Inventor: Håkan Olsson, Karlskoga (SE)

(73) Assignee: Morphic Technologies Aktiebolag (publ), Karlskoga (SE)

( * ) Notice: Subject to any disclaimer, the term of this patent is extended or adjusted under 35 U.S.C. 154(b) by 0 days.

(21) Appl. No.: 10/258,844

(22) PCT Filed: May 9, 2001

(86) PCT No.: PCT/SE01/01005

§ 371 (c)(1),
(2), (4) Date: Oct. 29, 2002

(87) PCT Pub. No.: WO01/92730

PCT Pub. Date: Dec. 6, 2001

(65) Prior Publication Data

US 2003/0089222 A1 May 15, 2003

(30) Foreign Application Priority Data

May 31, 2000 (SE) ..... 0002038

(51) Int. Cl.[7] ..... F15B 15/17
(52) U.S. Cl. ..... 91/416; 91/275

(58) Field of Search ..... 91/416, 417 R, 91/417 A, 235, 321, 275, 327

(56) References Cited

U.S. PATENT DOCUMENTS

| | | | | |
|---|---|---|---|---|
| 3,965,799 | A | 6/1976 | Juvonen et al. | 91/220 |
| 4,028,995 | A | 6/1977 | Salmi et al. | 91/276 |
| 4,474,248 | A | 10/1984 | Musso | 173/17 |
| 4,559,863 | A | 12/1985 | Storey | 91/165 |
| 4,635,531 | A | 1/1987 | Rode | 91/303 |

*Primary Examiner*—Edward K. Look
*Assistant Examiner*—Michael Leslie
(74) *Attorney, Agent, or Firm*—Michael D. Bednarek; Shaw Pittman LLP

(57) ABSTRACT

The present invention relates to a hydraulic DEVICE having a valve housing (1) with a movable valve body (2) arranged inside the valve housing, a hydraulic cylinder with at least a hydraulic chamber (115), and at least a control mechanism (4) for the control of said movable valve body (2), the valve body (2) is substantially sleeve-shaped and arranged inside an annular space (128) in the valve housing (1), and said valve body (2) is provided with a plurality of apertures (250, 251, 252; 206, 202) to make a flow of hydraulic liquid possible in the radial direction through the valve body (2).

21 Claims, 11 Drawing Sheets

HYDRAULIC PERCUSSION/PRESSING DEVICE

TECHNICAL FIELD

The present invention relates to a hydraulic device comprising a valve housing with a movable valve body arranged inside the valve housing, at least a hydraulic chamber provided inside said valve housing, and at least a control mechanism for the control of said movable valve body, wherein the valve housing comprises a plurality of combined elements, at least two of said elements being co-axially arranged so relative to each other that an annular space is formed between said two parts, the valve body is substantially sleeve-shaped and arranged inside said annular space in the valve housing, and said valve body is provided with a plurality of apertures to make a flow of hydraulic liquid possible in the radial direction through the valve body.

PRIOR ART

In many known applications, there is a need to perform a quick percussion motion and/or to perform a controlled motion, while heavy forces shall be transmitted, wherein some kind of a hydraulic device often is preferred (where hydraulic force transmission is utilised. According to prior art, such hydraulic devices are controlled/adjusted by a servo-valve suitable for large flows of oil at high pressures, which implies that the valve is very expensive. Further, it forms a unit of its own at a distance from the hydraulic device. Often, it may be the question of servo-valves with large outer dimensions, which thus are very bulky and may have a weight of hundreds of kilos. Further, a hydraulic hose must often be used between the servo valve and the hydraulic device, which as such implies an increased risk for damage. The high pressures, large flows of oil and the compressibility of the hydraulic hoses also imply that it will be difficult to meet high demands on rapidity and accuracy. Moreover, such servo-valves require a comparatively long adjustment time, often up to 100 msec, which is not satisfactory in many applications.

An application where long adjustment times are unsatisfactory is percussion presses. Percussion presses are previously known through e.g. U.S. Pat. No. 3,965,799, U.S. Pat. No. 4,028,995, and U.S. Pat. No. 4,635,531, which show arrangements with quick adjustments but where the hydraulic piston is part of the valve function. As a consequence, the function of the hydraulic piston may not be controlled at will, but the function is connected to the position of the hydraulic valve inside the valve housing. As to the field of applications, said devices are therefore limited to oscillating machines, in the first hand hammers, which move quickly between two positions, entirely without any possibility of control therebetween.

Said known type of percussion presses is not suitable for forming using high kinetic energy, which is a type of material treatment, such as cutting and punching, forming of metal components, powder compaction, and similar operations, at which the initial percussion is crucial, and as the speed of the press piston may be-about 100 times higher or more than in conventional presses. This fact puts very high requirements on the valve arrangement, as it must be possible to perform extremely quick adjustments of large flows, while high pressures exist in the hydraulic system in order to be able to adequately develop high forces. The operation principle is based on the generation of short-term but very high kinetic energy. It is not unusual that the power at the acceleration of the striking piston amounts to at least 20–30 KN in an average-sized percussion press. In order to be able to market such a machine, it is necessary to be able to offer a rugged construction, and at the same time it is desirable to be able to offer a valve assembly which is less expensive and which requires less space.

A condition for achieving such a valve function is the provision of a sleeve-shaped valve body between two co-axial portions of the valve housing, which thus forms an annular space, in which the sleeve-shaped valve body is provided. Said basic principle is indeed previously known through U.S. 4,559,863, but said publication refers to a stamp hammer where the hydraulics arein principle used only to lift the hammer. The only pressure which drives the hammer downwards is a residual pressure, which is accumulated in a low pressure accumulator after a quick return. In such a device, the gravity, and not the hydraulics, performs the essential operation in connection with the percussion. Thus, such a construction is not suitable at forming utilising high kinetic energy, wherein extremely high accelerations are necessary. Another disadvantage of the known device is that it does not make quick adjustments possible. Furthermore, it does s not make it possible to control the function of the hydraulic piston independent of the position of the hydraulic piston. Further, the known device is not balanced with reference to forces acting in the radial direction, which would inexorably lead to problems, if extremely high hydraulic pressures are applied.

It is realised that the application illustrated above is only one of many fields of application, where there is scope for essential improvements regarding the valve assembly and its mode of operation. Thus, it is evident that many of the problems which have been identified in connection with the percussion presses are also found within many other operation fields where it is as important to try to find a solution of the problems, or at least some of the identified problems. An example of such another field is hydraulic adjusting means, which, according to the above described servo-valve assembly, is today often an expensive and/or a too bulky solution, and/or a too slowworking device.

DISCLOSURE OF THE INVENTION

The object of the invention is to eliminate or at least to minimise the above mentioned problems, which is achieved by a hydraulic device according to the above description, which is characterised in that the valve body is located inside the valve housing in such a way that it is essentially, preferably entirely, balanced with reference to the hydraulic forces acting in the radial direction, that said valve body in the vicinity of said apertures is provided with edge portions at both the inner and outer surfaces of the valve body, which edge portions interact with edge portions and channels located inside the valve housing, so that hydraulic liquid is allowed to flow from each one of said channels and beyond and between each of said edge portions, when the valve body is positioned inside the valve housing to allow a flow of liquid to and from said hydraulic chamber, and that said edge portions at a second position of the valve body interacts in a sealing manner, so that the hydraulic liquid cannot flow to or from said hydraulic chamber.

Thanks to the solution according to the invention, very short flow passages are obtained, which makes extremely quick processes possible. Further, according to the invention it is also possible to control the hydraulic piston independent of the position of the hydraulic piston. In this connection, it is an advantage that the valve body is formed as a sleeve-shaped means, as large flow apertures thereby may be achieved with comparatively small motions.

It is realised, thanks to the invention, that a solution with all the advantages which are obtained may be used in a lot of different applications.

According to further potential aspects of the invention:

the edge portion of the valve body is an integrated part of at least one of said apertures;

the valve body is essentially symmetrically shaped with reference to a plane running centrally across the valve body;

the maximum, necessary movement of the valve body within the valve housing to move the valve body from a shut to an open position is between 0.1 and 3% of the outer diameter of the sleeve, preferably below 2%, and more preferred below 1%.

the movement of the valve body between the shut and open positions is at least substantially performed in the axial direction with reference to the hydraulic piston;

the adjustment time for the valve body from one end position to the other end position is below 10 msec, preferably below 5 msec;

the hydraulic piston is provided with at least two annular, force-transmitting surfaces, which are opposite each other, wherein preferably the upper annular surface is larger than the other one;

the hydraulic piston comprises three co-axial, integrated units with different outer diameters, wherein the centre portion is provided with the largest diameter;

at least one control mechanism is activated in a hydraulic manner;

the control mechanism comprises means provided to be capable to move the valve body, which means are movable in apertures in the valve housing, wherein the apertures essentially correspond to the shape of said means, and that said apertures communicate with an annular channel intended to be pressurised by hydraulic oil;

the means have a circular, outer jacket surface, and that said apertures consist of circular holes extending in the axial direction;

the control mechanism is activated in a magnetic manner;

the control mechanism comprises at least one ferromagnetic portion provided at the valve body and at least one electromagnet provided at the valve housing;

the electromagnet is cooled by hydraulic oil;

the valve housing is provided with a pressure connection and a tank connection in one or several of its side walls;

the device is a part of a percussion/pressing means intended to perform quick percussions and to transmit heavy forces, wherein the valve body has a minimum diameter between 3 and 500 mm, preferably exceeding 50 mm, and more preferred exceeding 80 mm;

at least one of said edge portions is provided with symmetrically arranged recesses, which, at a small movement of the valve body from its shutting position, allows a minor flow to occur in the radial direction through the valve body;

the length of the edge portions and hence the total area of the apertures may vary by varying the position of the valve body in the rotating direction;

the valve body is positioned by the hydraulic pressure acting on the annular surfaces, wherein the hydraulic fluid to at least one of said surfaces is controlled by a valve slide provided in the valve body and working according to known principles for copying valves, so that the surrounding valve body slavishly follows said valve slide, which in turn is positioned by a double-acting electromagnet;

a hydraulic piston provided in the hydraulic chamber with at least one outwardly facing end surface, wherein the hydraulic piston is located inside the valve housing in a co-axial manner;

the valve housing is provided with two separate hydraulic chambers.

BRIEF DESCRIPTION OF DRAWINGS

The invention will be described more in detail with reference to the enclosed drawings, of which:

In FIG. 1 there is shown a hydraulic percussion/pressing device according to a first embodiment of the invention, which embodiment is especially suitable for performing long percussion motions. The device comprises a valve housing 1, a hydraulic piston 3 being arranged centrally in the valve housing, a valve body 2 being arranged inside the valve housing 1 but surrounding the hydraulic piston, and a control mechanism 4.

Figure 1:
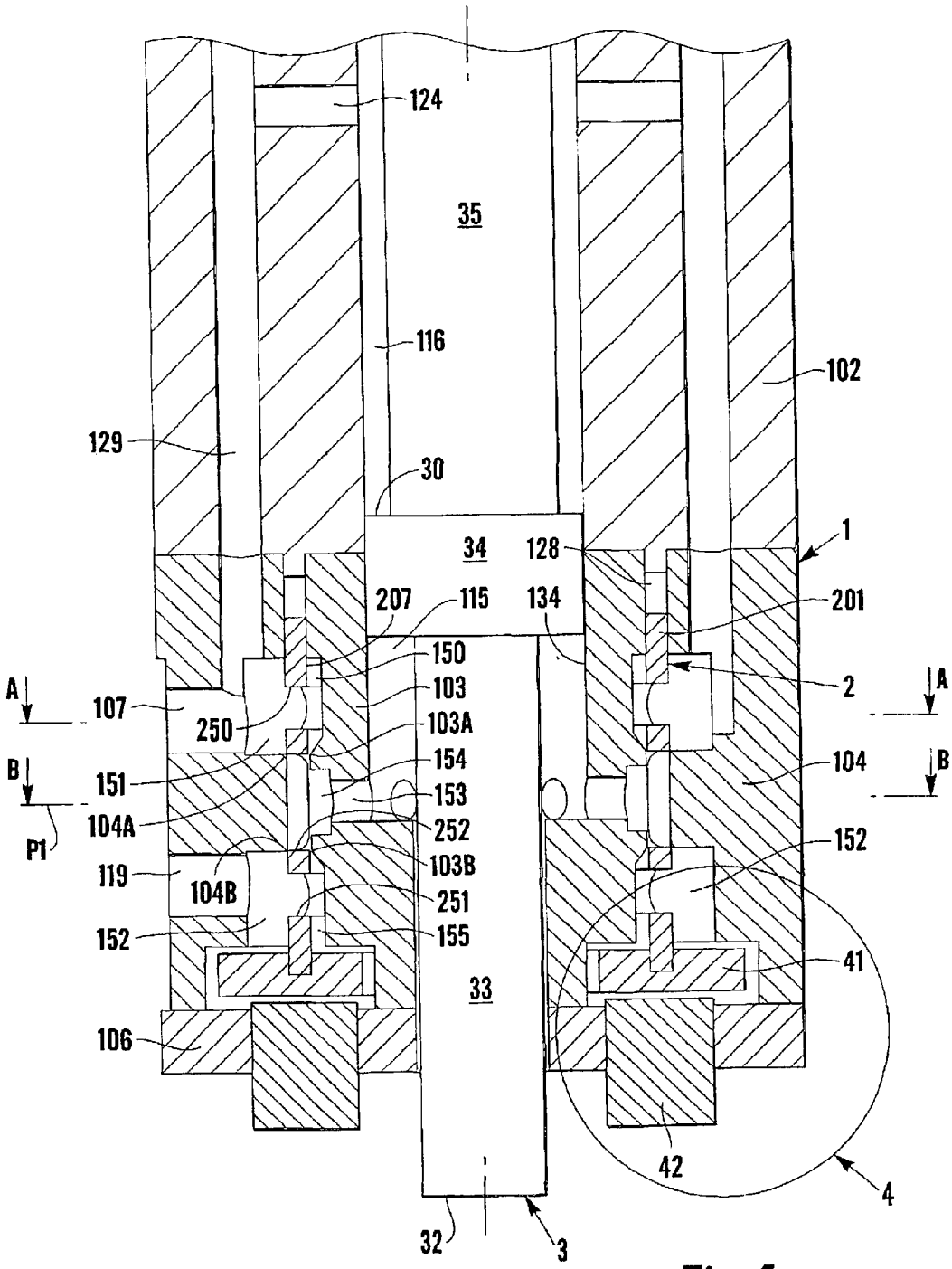
FIG. 1 in an axial cross-section, shows a first embodiment of a hydraulic device according to the invention.

The valve housing 1 comprises a plurality of assembled parts, comprising an upper portion 102 arranged at an upper cap 101 (not shown). At the lower end of the upper portion 102 an inner valve seat portion 103 and an outer valve seat portion 104 connects. At the lower end of said two portions 103, 104 there is a lower, common cap 106. Centrally, along the centre axis of the valve housing 1 there is an upper circular cavity 116, a first hydraulic chamber, in which the hydraulic piston 3 is provided. Said circular cavity 116 has a diameter which is adapted to the centre portion 34 of the hydraulic piston, which portion shows the largest diameter of the hydraulic piston. Above said centre potion 34 of the hydraulic piston there is an upper portion 35, the diameter of which is smaller than the centre portion 34, so that an annular, upwardly facing surface 30 is formed. Said surface 30 is a power-transmitting surface for hydraulic oil, which is pressurised within the annular slot existing between the upper portion 35 of the hydraulic piston and the inner jacket surface of the valve housing.

Figure 2:
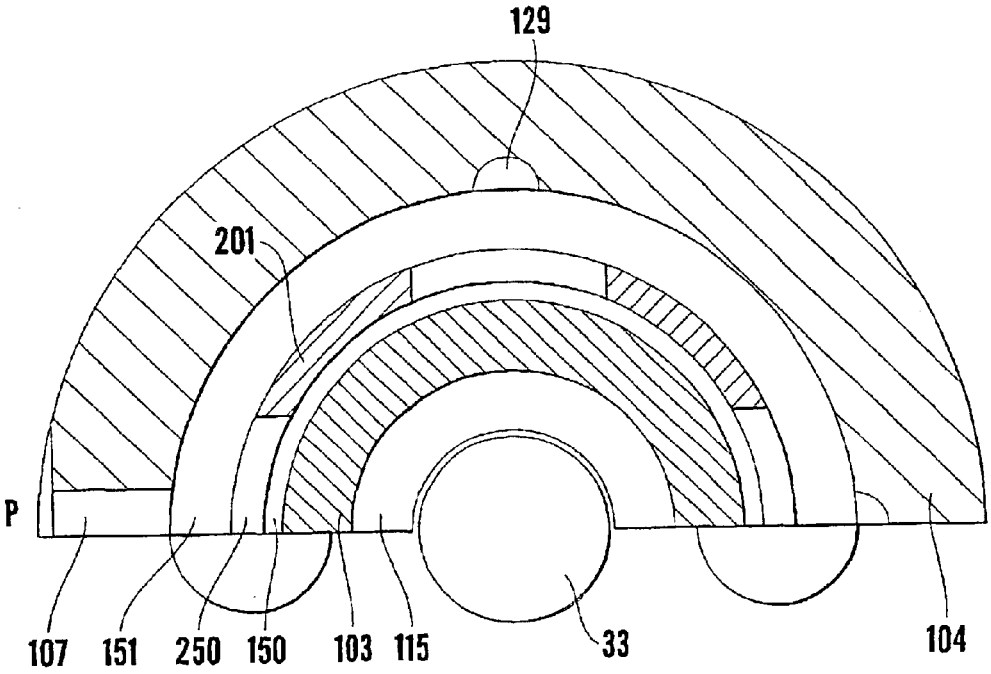
FIG. 2 shows a cross section along the line A—A of FIG. 1.

An essential portion of the inner jacket surface 134 of the inner valve seat portion 103 has the same diameter as the central cavity 116 in the upper portion 102, which makes it possible for the hydraulic piston 3 to move together with the centre portion 34 an essential distance along the central cavity 115 forming the second hydraulic chamber inside the inner valve seat portion 103. The lower portion 33 of the hydraulic piston 3 has a diameter, which is smaller than the upper portion 35. Thus, a downwardly facing, annular surface 33 is formed, the surface of which is larger than the upwardly facing, annular surface 30. Said surface 30 may via the axial channels 129 and the radial, upper channels 124 be subject to a constant pressure via the pressure inlet 107. The lower portion of the inner valve seat portion is provided with a circular aperture, the diameter of which is adapted to the diameter of the lower portion 33 of the hydraulic piston, so that a substantially tight fit therebetween exists. Preferably, some kind of a sealing is provided in said portion, as well as in other portions provided with a good fit, in order to minimise leakage (not shown). In the outer portion 104 of the valve seat there is at least one inlet 107 for the hydraulic liquid as well as an outlet 119 for the hydraulic liquid. In immediate connection to the inlet 107 there is an annular channel 151 (see also FIG. 2). In connection to said annular channel 151 there is a slotted, cylindrical space 128 between the outer valve seat portion 104 and the inner valve seat portion 103, which space is intended for the valve body 2. At the opposite side, and on the other side of said slit 128, an additional annular chamber 150 is provided in the inner valve seat portion 103.

Figure 3:
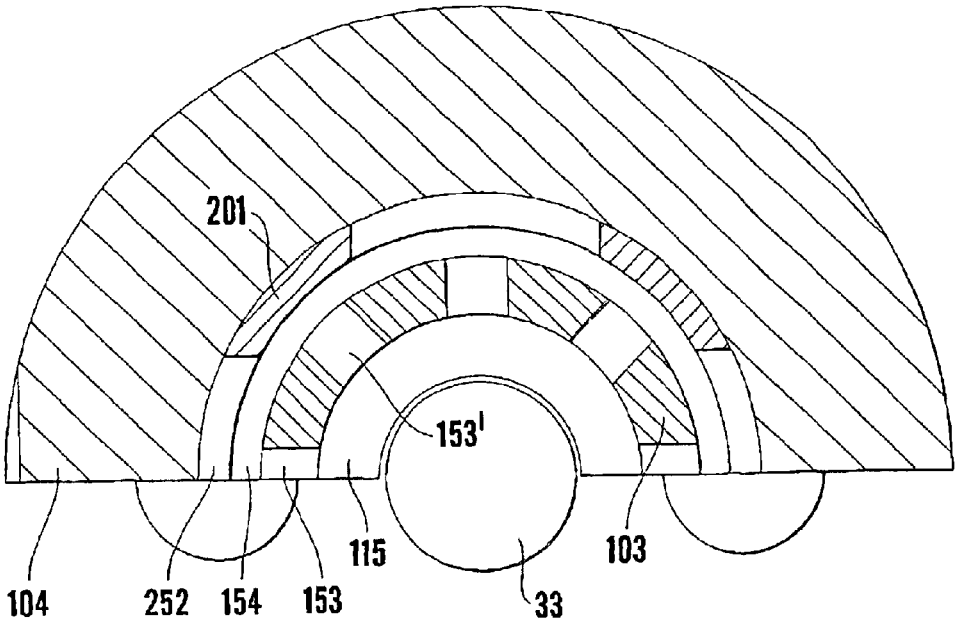
FIG. 3 shows a cross section along the line B—B of FIG. 1.

Below the annular chamber 151, between the inlet 107 and the outlet 119, an annular portion with inwardly directed sharp edges is provided in the outer valve seat portion 104, wherein an upper sealing, annular corner/edge portion 104A and a lower sealing, annular corner 104 are formed. In a corresponding manner, inside the slotted space 128 and opposite to said annular corner/edge portion, annular edge portions are formed in the inner valve seat portion 103 through an upper, annular edge portion 103A and a lower, annular edge portion 103B. Said annular corner/edge portions 103A, 103B, 104A, 104B interact with the axially movable valve body 2 and the apertures 250, 251, 252 therein to achieve the desired adjustment (see FIG. 2). The upper 250 and the lower 251 apertures, respectively, in the valve body 2 are provided in a plurality to make free hydraulic flow possible in a balanced manner. Also the centre row 252 of apertures is made with a plurality of apertures (see FIG. 3). Said apertures 252 are preferably provided with straight lower and upper edges to be able to interact with said corner/edge portions in a more efficient way. Channels 152, 155 and apertures 251 are arranged in the same way in connection to the outlet to a tank 119, which are related to the channels being connected to the pressurised aperture 107, so that in principle a mirror symmetry exists around a plane P1 running through the centre of the apertures 153 to the lower pressure chamber 115. An iron ring 41 is attached to the lower end of the valve body 2. Below said iron ring and co-axially relative to it, one (or several) electromagnets 42 is (are) provided for the control of the valve body 2. The valve body is also provided with a small, annular surface 207 at its upper portion, which annular surface 207 implies that when the pressure is acting inside the chamber 151, an upwardly directed force will always act through the annular surface 207. Thanks to the limited motion requirement, the control/movement of the valve body 2 may advantageously take place in a magnetic manner.

A number of axially arranged channels 129 is provided to connect the pressure chamber 151 with the upper, annular cavity 116 in the valve housing 1, which channels via radial borings 124 in the upper portion of the valve housing fall into the annular aperture/slit 116.

The valve functions in the following way. In the position shown in FIG. 1, no transport of oil takes place in any direction but the hydraulic piston 3 will be in a balanced position, as oil, which has been brought up through the channels 129, presses against the upper surface 30, which is counter-balanced by the oil which is encompassed inside the lower chamber 115, and which acts via the downwardly facing, annular surface 31. The position of said equilibrium position, wherein the piston thus stands still, may be adjusted optionally and thus depends on the amount of oil being encompassed in the lower chamber 115. If now an increased voltage is supplied to the electromagnet 42, this will give a force via the iron ring 41, which will draw the valve body 2 downwardly.

When this happens, apertures will be created between the two lower, annular edges 104B, 103B, and the valve body 201, and the edge at the centre apertures 252, so that oil may flow from the lower, annular space 115 via the apertures/channels 153, 154, 252 and out into the annular channel 152 and then flow further out through the outlet 119 to a tank. At the same time the upper, annular edge portions 104, 103A seal against the valve body 201, so that no oil may flow from the pressure chamber 151 down towards the inlet aperture 154 into the inner, lower, annular chamber 115. On the other hand, a constant oil pressure is maintained via the axial channels 129, and the radial channels 124 in the annular, upper chamber 116, which act towards the upper, annular surface 30. Thus, this will lead to a movement of the piston in a downward direction, so that its lower end surface 32 is moved downwardly, possibly to perform a stroke. Said stroke, in the downward direction, will become more powerful than the upward motion, as the total area of the upper surface 30 is larger than the area located below and inside this at the lower surface 31. Again it should be noted, that the apertures 252 in the centre of the valve body are suitably designed with flat upper and lower surfaces, so that a slight movement of the valve body implies a great change of the aperture being exposed to oil to be moved from the chamber 115 out towards the outlet 119.

According to the example shown, the outer diameter D of the valve body is 100 mm, which when the valve body is moved by only 1 mm gives, in relation to the movement, a very large flow aperture. (The total surface will amount to about 600 $mm^2$ ($D \times \pi \times 1$ mm, when two edges are used), as the edge portion extends all around. When the percussion motion has finished (or the desired position has been reached, or the pressing) the current supply to the electromagnet 42 is terminated (reduced), so that the pressure acting on the surface 207 of the valve body 2 overcomes the magnetic force, which leads to the valve body being rapidly moved upwards. In this way, an opposite oil flow will take place, as apertures between the upper, annular edge portions 104A, 103A and the valve body 201 are now created. Thus, the oil in the pressure chamber 151 will thereby be able to flow freely down through the apertures 252 of the valve body, further into and through the annular chamber 154, and then via the radial apertures 153 into the lower, annular pressure chamber 115. As a consequence of the increased pressure in the lower, annular chamber 115 (which pressure is the same as in the upper, annular chamber 116), the piston will move upwardly, as the lower, annular surface 31 has a much larger surface than the upper, annular surface 30. When the return motion has taken place to the desired position, the control mechanism is activated again to make a new percussion (or pressing) possible in accordance with what has been mentioned above. If instead, the device is used as an adjusting means, the current supply to the electromagnet is only changed so much that the valve shuts (the position according to FIG. 1), wherein the piston 3 stops in the desired position.

It should be mentioned, that the valve body is in a balanced state all the time, in the radial direction, as the radially exposed surfaces of the valve body at every chosen point are exposed to as large of a counter-directed force at the opposite side of the valve body 2. This is achieved thanks to the annular recesses having been created in a symmetrical manner around the valve body and to the apertures in the valve body, which enables communication between said annular spaces. As already mentioned in the preamble of the description of FIG. 1, said embodiment is especially suitable for a device with a long stroke.

Figure 4:
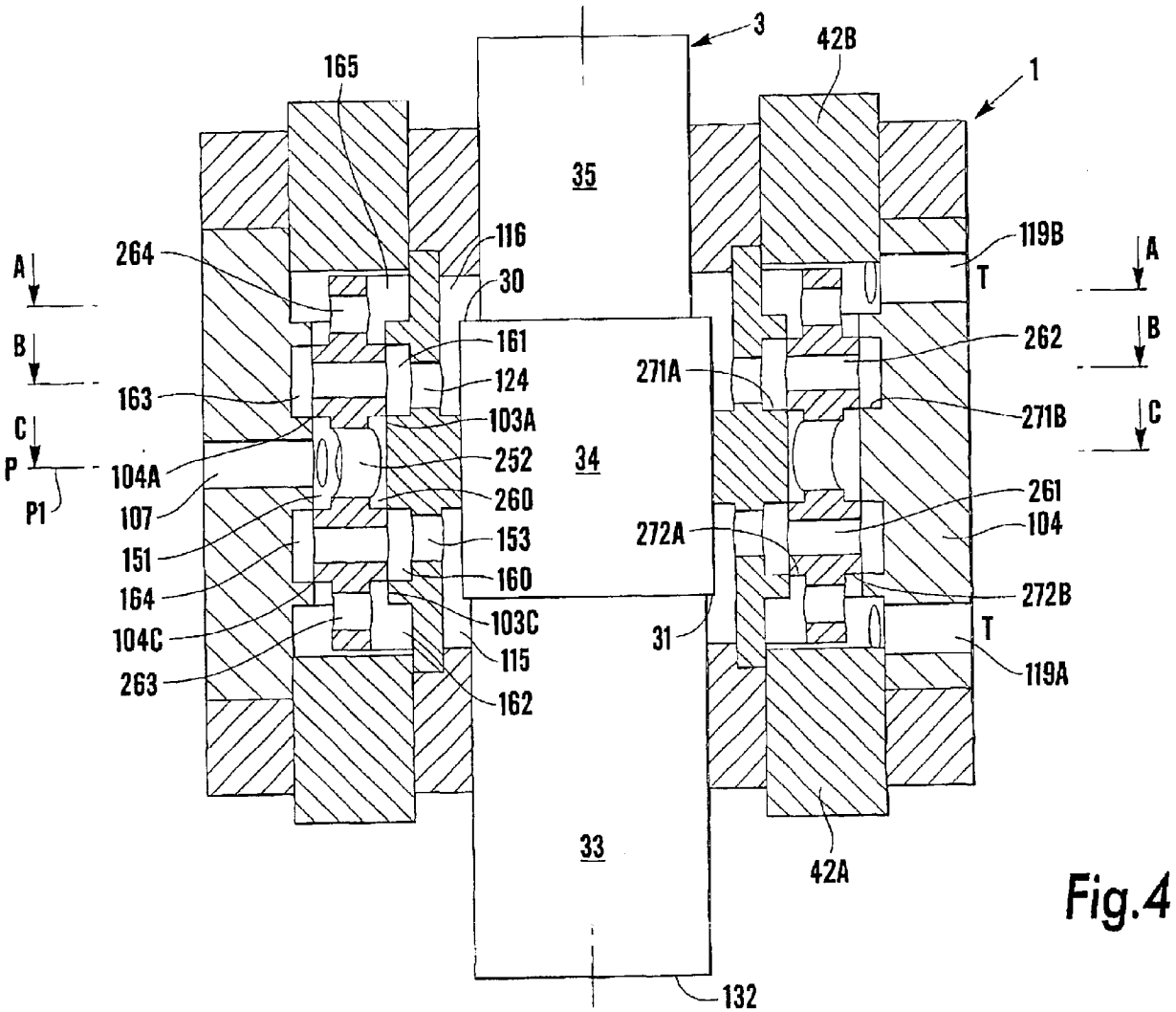
FIG. 4 shows a cross-section in the axial direction of a preferred embodiment according to the invention, which is especially suitable for quick motions.
Figure 5:
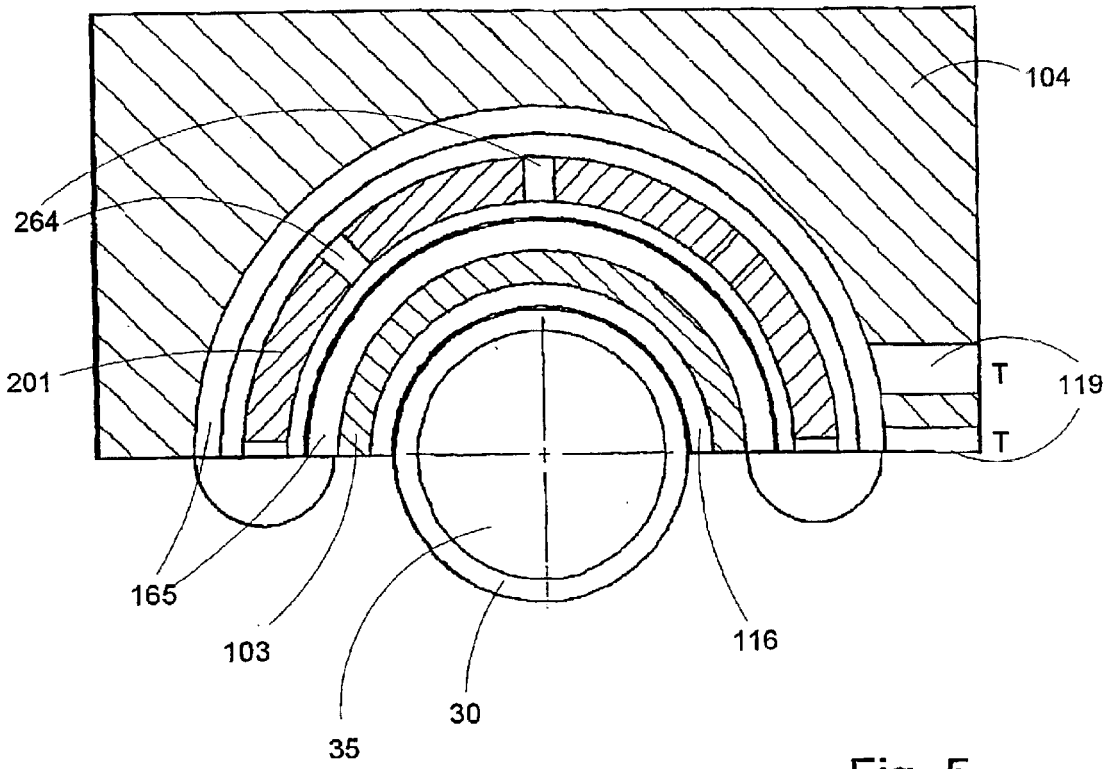
FIG. 5 shows a cross section along the line A—A of FIG. 4.
Figure 6:
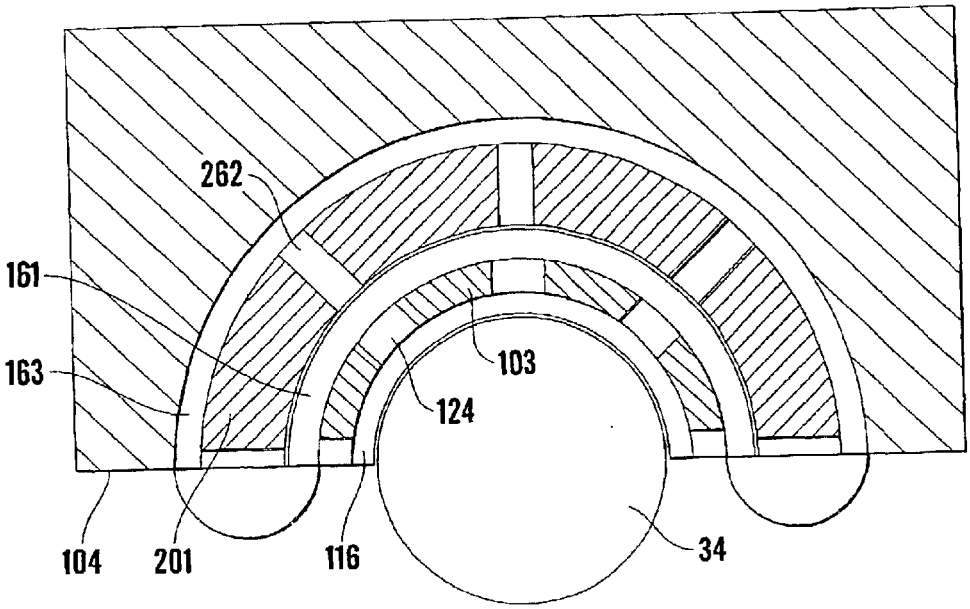
FIG. 6 shows a cross section along the line B—B of FIG. 4.
Figure 7:
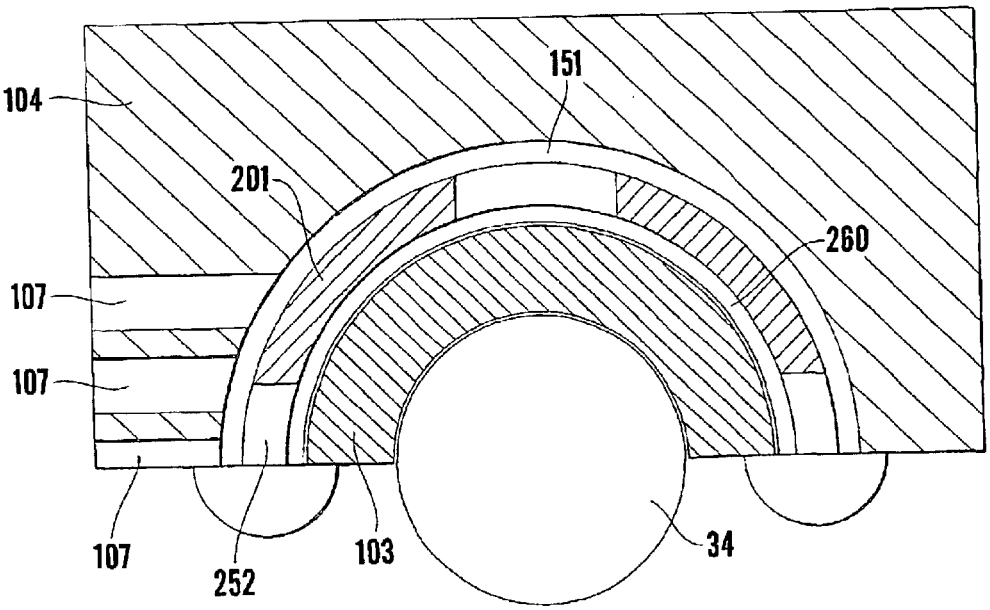
FIG. 7 shows a cross section along the line C—C of FIG. 4.

The preferred embodiment according to FIG. 4 shows many essential similarities to the embodiment according to FIG. 1 but is more suitable for short and quick motions. A first important difference is that one does not pressurise constantly in any direction but uses alternating pressurisation around the piston to influence it in one direction or another. Another important fundamental difference is that the valve body 201 according to this embodiment is magnetic as such, and therefore no extra iron ring 41 is needed but the electromagnets 42A, 42B (two) on each side of the valve body 2 may be used to control the position of the valve body 2. An additional difference is that there are two outlets 119A, 119B running to a tank. As the basic principle for how the details of the construction interact in the already described embodiment according to FIG. 1 and the embodiment shown in FIG. 4 in principle are the same, only "one half" of the symmetrically constructed device will be described below. This will be made considering movement of the piston only in one direction. First, additional differences in relation to the embodiment according to FIG. 1 will however be described. The valve housing 104, 103 and the valve body 2, respectively, are provided with four, pair-wise arranged, annular edge means of which only two interact at a time in an opening manner, while the other two pairs interact in a shutting way. Below, only the pair 103A, 104A, and 103C, 104C, respectively, which interacts (in an opening manner), when the piston 3 performs a stroke in the downward direction. Like the embodiment according to FIG. 1, there are a plurality of centrally provided apertures or openings 252 in the valve body 2. Said aperture is intended for balancing the pressure and to accomplish quick, short flow paths (see also FIG. 7). Further, it is shown that there is a plurality of inlets for hydraulic liquid 107. It can also be seen that to achieve a pressure balance at said centre plane P1, there is an annular recess 260 in the inner jacket surface of the valve body 2. On each side of the row of central apertures 252 in the valve body 2, there are provided a number of radial apertures 261 and 262, respectively, in the valve body 2, in a symmetrical way in relation to the centre plane P1 (see also FIG. 6). Said apertures create communication between an outer 163 and 164, respectively, annular chamber, which is provided in the outer valve seat portion 104, and an inner, annular chamber 161 and 160, respectively, which is arranged in the inner valve seat portion 103. Said inner chambers 160 and 161, respectively, communicate with the apertures 124 and 153, respectively, which run to respective pressure chamber 115 and 116, respectively. Finally, it is shown that the valve body is provided with an additional set of radial apertures 263 and 264, respectively, which are symmetrically arranged with reference to said plane P1, and which are provided in an inner, annular chamber 162 and upper annular chamber 165, respectively. Said lower and upper, respectively, annular chamber communicates directly with a lower 119A and an upper 119B, respectively, outlet running to a tank (see also FIG. 5).

A device according to the preferred embodiment shown in FIG. 4 functions in the following way. The pressure is on via the inlets 107 (of course, only one inlet may be used) and pressurises thus the annular chamber 151 communicating with the centre aperture 252 in the valve body 2. When the position according to FIG. 4 has been reached, no movement of the hydraulic piston takes place in any direction, as all flow paths out of the annular chamber 151 and 260, respectively, are sealed, as the edges slightly overlap each other. When thus the upper electromagnet 42 is supplied with current, the magnetic field will move the valve body 2 in an upward direction as viewed in the figure. In that connection, apertures will be created between the annular edge portions 271A, 271B and 272A, 272B, respectively, of the valve body along the entire edge lines, so that oil may flow between the annular slits created between the edge portions 104, 271B and 103A, 271A, respectively, from the central, annular chamber 151 and 260, respectively, upwardly into the two upper annular chambers 161 and 163, respectively. From here, the pressurised oil may then flow freely into the inner, upper, annular chamber 116 via the radial apertures 124 and then pressurise the piston downwardly via the upper surface 30. At the same time the corresponding slits 104C, 272A and 103C, 272B, respectively, are opened at the bottom, wherein oil may flow out from the lower, annular pressure chamber 115 via the radial apertures 153 into and through the annular chamber 160 and either directly down through the inner, annular slit 160 or through the apertures 261 in the valve body 2 via the other annular slit 164 down into the lower, annular chamber 162 and out through the outlet 119A to a tank. Thus, a pressurisation of the upper, annular chamber 116 instantaneously takes place, while drainage of the lower, annular chamber 115 is performed. As a consequence of this process, the piston 3 will perform a rapid, downwardly directed motion, and the end surface 132 of the piston may then effect a powerful stroke. When thus the stroke has been performed by means of the lower magnetic device 42A, the motion of the valve body 2 is reversed, and an opposite pressurisation and drainage, respectively, takes place so that the piston instead moves upwardly. It should be noted that the unbroken, interacting edge lines, e.g. 104C and 272A, imply that an extremely small motion of the valve body 2 leads to a large aperture, i.e. that a large annular slit is formed, so that large flows may be accomplished. It should also be noted that thanks to the provision of surfaces 30 (instead of utilising the end surfaces of the piston 3) a comparatively small change of the volume is achieved when moving the piston in any direction, which further improves the rapidity of the device. However, it should be noted that the device is not limited to the two end surfaces of the piston having to protrude out of the valve housing 1. Further, as can be seen from the sectional views, the valve housing may advantageously be designed with a rectangular outer shape.

Figure 8:
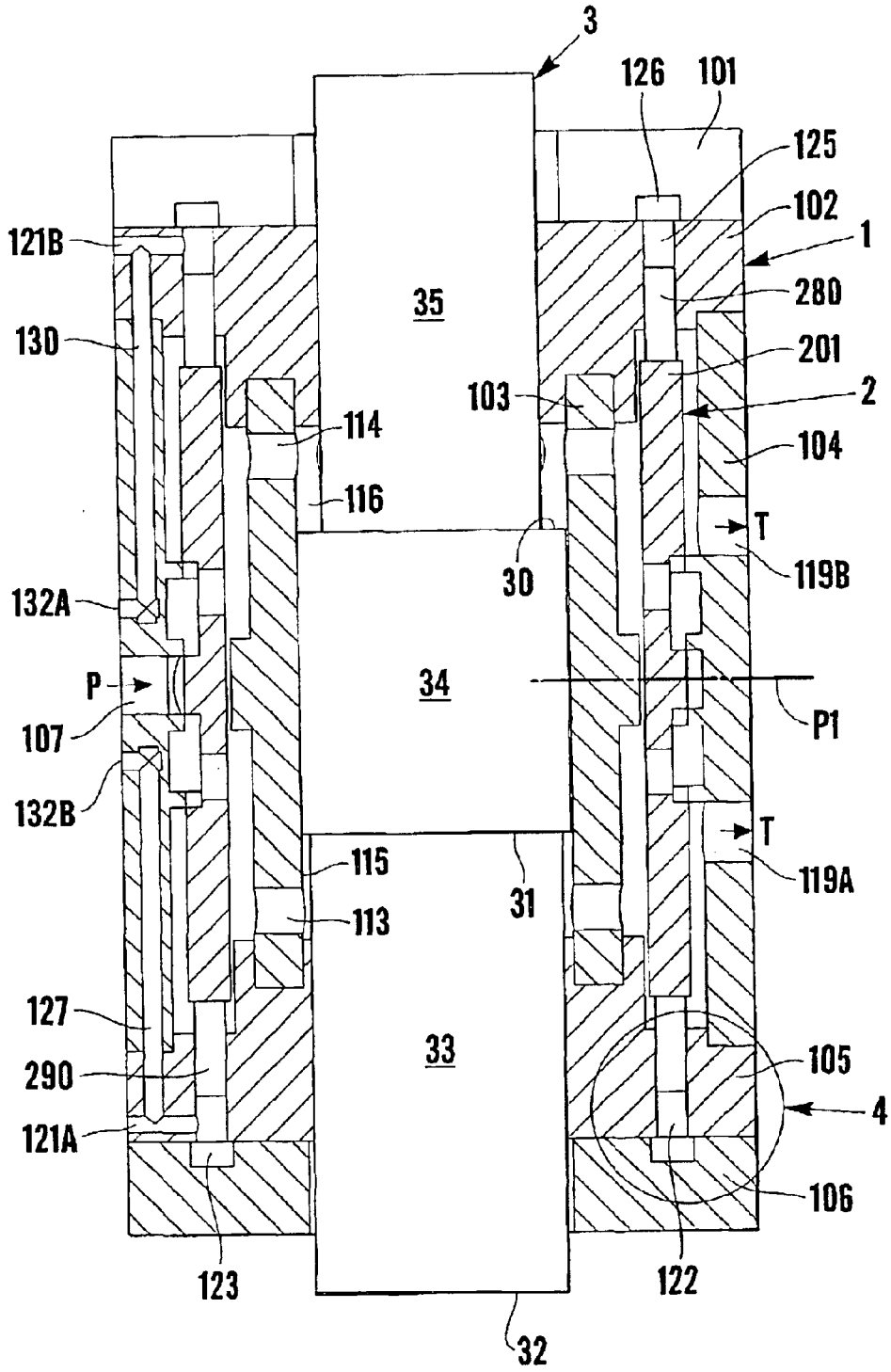
FIG. 8 in an axial cross-section shows an alternative embodiment of a device according to the invention.

In FIG. 8 an additional embodiment of a hydraulic device according to the invention is shown. As the basic principle to a large extent is the same as the one already described above, only essential differences will be discussed below. A first, important difference is that the valve body 2 according to this embodiment is not entirely balanced. Thus, this device is less suitable as a servo valve, if a very great accuracy is required, as the valve body to a certain extent will press against the central, protruding portion of the inner seat portion 103, when the inlet 107 for the pressure liquid always is pressurised. However, the most important difference is the control mechanism 4 for the movement of the valve body 2. According to this embodiment, it is shown that a hydraulic control mechanism 4 is used. This is effected by the fact that a number of protruding means 280 and 290, respectively, are provided on both sides of the valve body 2, on both the upper and the bottom side, which means may press the valve body in either direction. Suitably, they are circular and run in a sealing way in circular borings 122 and 125, respectively, in the valve housing 1. By providing annular channels 123 and 126, respectively, in connection to said borings 122 and 125, respectively, one may by alternating pressurisation of said annular channels influence the valve body 20 to move in either direction. The pressurisation of the annular channels 123 and 126, respectively, is suitably performed via the inlets 132A and 132B, respectively, in order to have the connection in the vicinity of each other. However, they are preferably not placed in the same plane (the figure shows this only in order to be able to illustrate the function more distinctly). Thus, there are axial channels 127 and 130, respectively, from each inlet to the control mechanism, which channels via radial borings 121A, 121B run to said annular channels 123 and 126, respectively. Thus, it should be noted that the radial borings 121A, 121B must be plugged at the ends, so that oil will not flow out of the valve housing 1. Like FIG. 4, an embodiment is shown in FIG. 8, wherein an alternating pressurisation of one of the two chambers is performed, while the non-pressurised chamber is drained by being connected to a tank.

Figure 9:
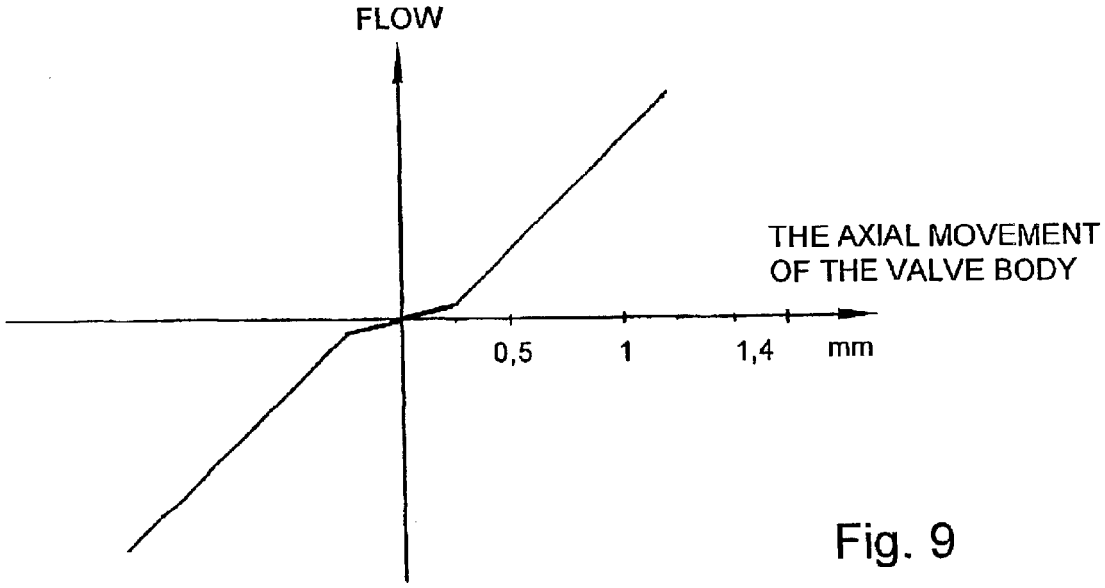
FIG. 9 in the form of a diagram shows the effect of a preferred embodiment of the invention.

In FIG. 9 a diagram is shown, which clarifies the effect of an embodiment improving the control possibility for all applications, wherein the surrounding valve will serve as a servo valve, i.e. for the positioning of the hydraulic piston. As an example, reference is made below to FIG. 1, but it should be realised that the principle may also be used for other embodiments. The effect is achieved by for instance making the edges 103A, 103B, 104A, 104B, which take care of the aperture of the oil flow to the annular ring areas (e.g. 154) partially bevelled, so that the aperture edges during the first motion from the central position, e.g. about 0.2 mm, only comprises e.g. 10% of the circumference, and that they after said opening motion of about 0.2 mm allow the valve to open around the entire circumference. In this way, a more accurate control is achieved at low speeds (or standstill), as small flows give a quieter control process. In addition, the leakage decreases along the long circumference. It is important that the change of the edge portions is symmetrically performed, so that the balancing is good. It is realised that there are many alternatives to bevelling in the edge region, e.g. symmetrically placed indentions, in the edge regions, etc.

Figure 10:
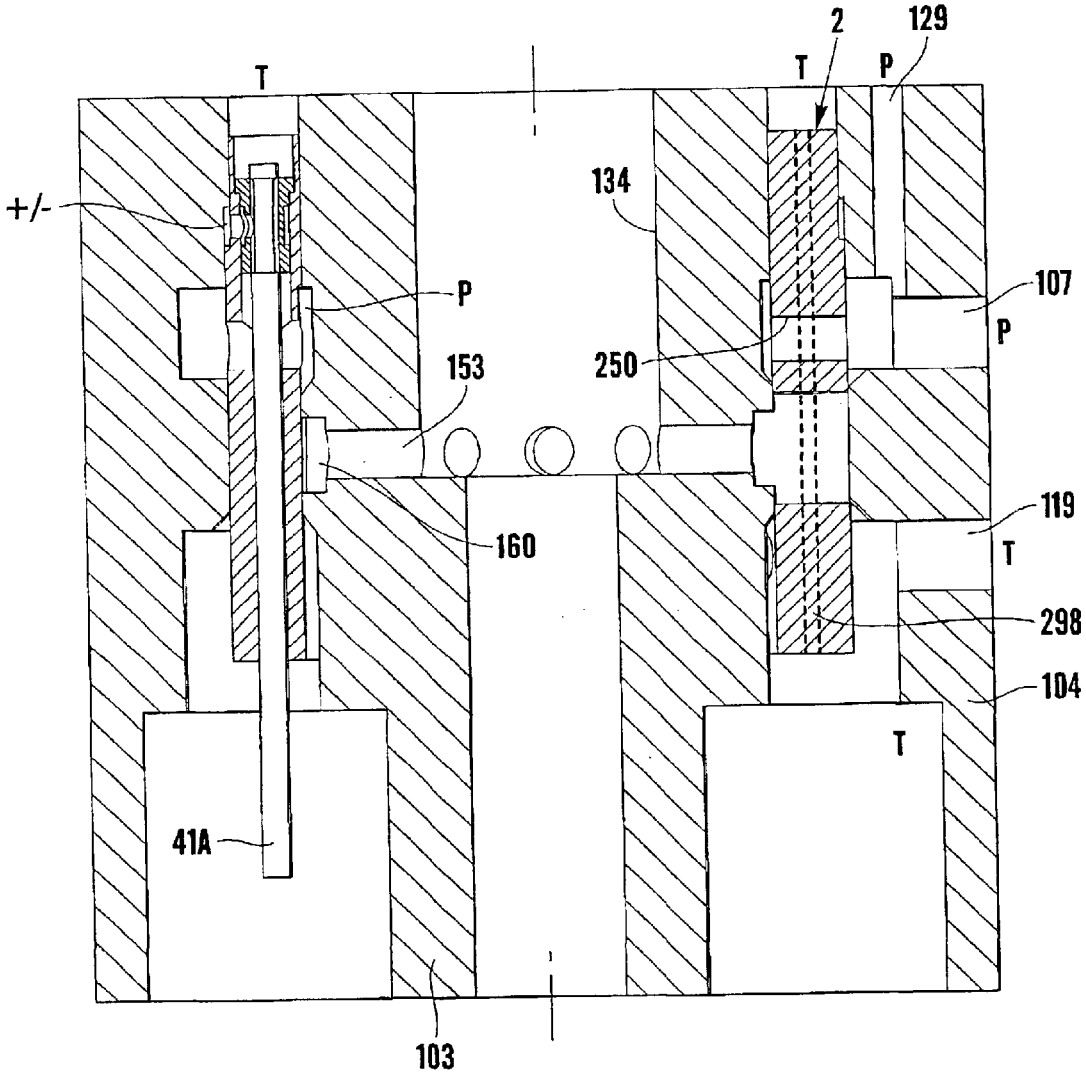
FIG. 10 shows an alternative embodiment according to the invention.
Figure 11:
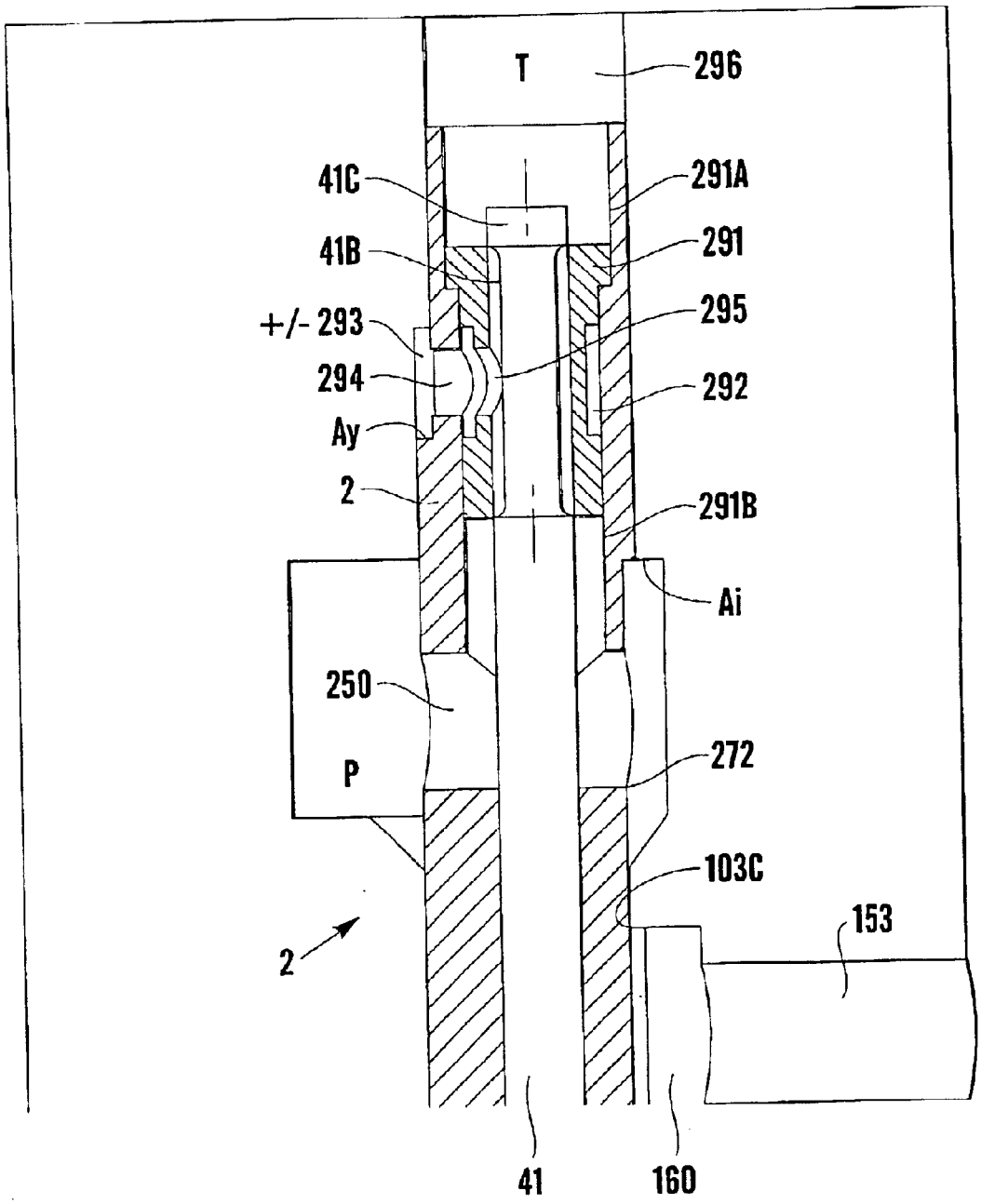
FIG. 11 shows an enlarged view of certain details in FIG. 10.

In FIG. 10 an additional embodiment/modification of the invention is shown, wherein a copier valve mechanism is built-in in the surrounding valve sleeve 2. The fundamental principle and the design of said hydraulic device is essentially the same as described above, and therefore many of the designations, which are found in FIG. 10, are already mentioned in connection with the figures described above. Below, focus will therefore only be put on essential changes. Further, only one limited portion of such a hydraulic device is shown, e.g. no hydraulic piston or bottom plate is shown in the figure, but it is realised that the principles of said details as well as of the other necessary peripheral details are the same as described above. In principle, like what is described above, a double-acting electromagnet is used to influence/control the valve device, but in this case via a copier valve bar 41A. Other details forming parts of the copier valve mechanism will be described more in detail with reference to FIG. 11. A vertical channel 298 is provided through the movable valve sleeve 2, so that a lower pressure corresponding to the outlet pressure to a tank (T) exists on the upper side of the slotted space 128, in which the valve sleeve 2 moves. As may be seen in FIG. 11, a sleeve-shaped lining 291 is provided and fixedly secured inside the valve sleeve 2. The diameter of the longitudinal aperture inside said lining 291 is the same (with a certain fitness) as the diameter of the copier valve bar 41A. In the shown position, the copier valve bar 41A extends with its upper end 41C above the upper edge portion 291A of the lining. In the space between the upper edge portion 291A of the lining and the lower edge portion 291B of the lining, the bar 41A is provided with a narrower web 41B, so that sealing edges are formed both at the lower 291B and the upper 291A edge portions of the lining against the edge portions at the ends of the web 41B. A radially extending aperture 295 is provided in the middle of the lining, which aperture communicates with a slotted space 292 surrounding the lining 291. Said space 292 is in turn in communication with an annular channel 293 via an aperture 294 in the valve sleeve 2. The valve sleeve 2 aims at moving upwardly because the pressure P in the surrounding chamber acts on the surface Ai of the valve sleeve 2. Said pressure, which is thus transmitted via the channel 107, reaches also the lower edge of the lining 291 via the slotted space between the copier valve bar 41A and the valve sleeve 2. In accordance with what has already been described, the lower tank pressure T exists on the upper side of the lining 291. When the copier valve bar 41A moves upwardly, the hydraulic chamber 293 will be connected with a tank T via the upper slotted space 128, which via the channel 298 always has a low pressure T. When the copier valve bar 41A is moved downwardly in relation to the valve sleeve 2, the hydraulic chamber 293 will be pressurised P via the channel 107. Said pressure influences the surface Ay of the valve sleeve 2, which is provided inside the hydraulic chamber 293. The surface Ay, which faces upwardly, is larger than the downwardly facing surface Ai, which surfaces thus give component forces in opposite directions ($F=p\times A$), preferably is $Ay-2\times Ai$. Thus, the pressure inside the chamber 293 depends thereon from which direction the oil flows into the chamber 293; either a low pressure T via the sealing edge 291A or a high pressure P via the sealing edge 291B, which pressure then is transmitted to the inner aperture 295, the channel 292 and finally through the outer aperture 294, which results in the valve sleeve 2 moving in the same direction as the valve bar 41A has moved, until its balance position is reached by the valve edges 291A, 291B again shutting the respective sealing edge at the web 41B, wherein thus a copying of the movement of the valve bar is achieved.

Figure 12:
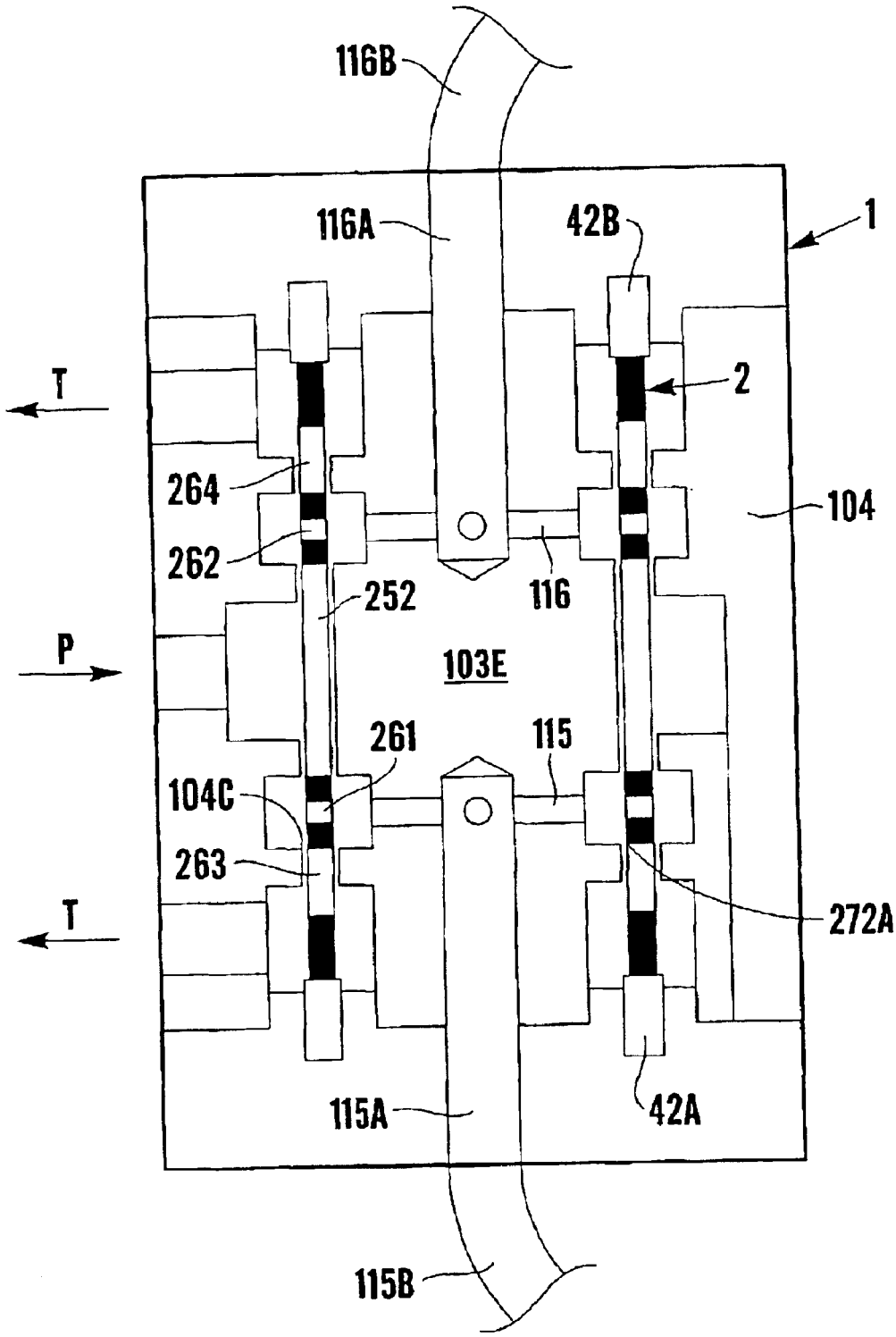
FIG. 12 in an axial cross-section shows a modified hydraulic device according to the invention.

In FIG. 12 an alternative embodiment of a device according to the invention is shown, wherein it is apparent that the valve device must not necessarily have the hydraulic piston 3 located inside the valve housing. In many applications, it may in fact be desirable to separate the valve housing 1 and the hydraulic piston/cylinder as such. The principles of the valve function are exactly the same as is described with reference to FIG. 4. Thus, the same denotations have been used as in FIG. 4, but certain parts of the device according to FIG. 12 are more schematically shown. Below, focus will therefore only be put on the differences in relation to FIG. 4. As already mentioned, the hydraulic piston 3 is not provided inside the valve housing 1. Instead, the centre portion 103E is formed as a homogenous unit. The lower pressure chamber 115 communicates with an outlet 115A, which is connected to a conduit, preferably a hydraulic hose 115B leading to a corresponding lower pressure chamber in the hydraulic cylinder (not shown), which is provided with the hydraulic piston 3 (not shown). The hydraulic piston 3 and the cylinder are suitably in principle designed in an entirely conventional manner, wherein the design depending on application may be adapted to the desired functional pattern, e.g. to give the hydraulic piston 3 a functional pattern according to any of the above described embodiments. In a corresponding manner, the upper pressure chamber 116 is connected to an upper outlet 116A, which is connected to an upper hydraulic conduit 116B, also preferably being a hydraulic hose, running to a corresponding upper hydraulic chamber inside the hydraulic cylinder, which is provided with the hydraulic piston 3. Thus, the function becomes exactly the same as described with reference to FIG. 4, but with the difference that the hydraulic cylinder with the hydraulic piston 3 is arranged at a distance from the valve housing 1. Further, it may be seen from FIG. 12 that the valve sleeve 2 may advantageously be designed with the same, or at least almost the same, wall thickness along its entire extension.

Figure 13:
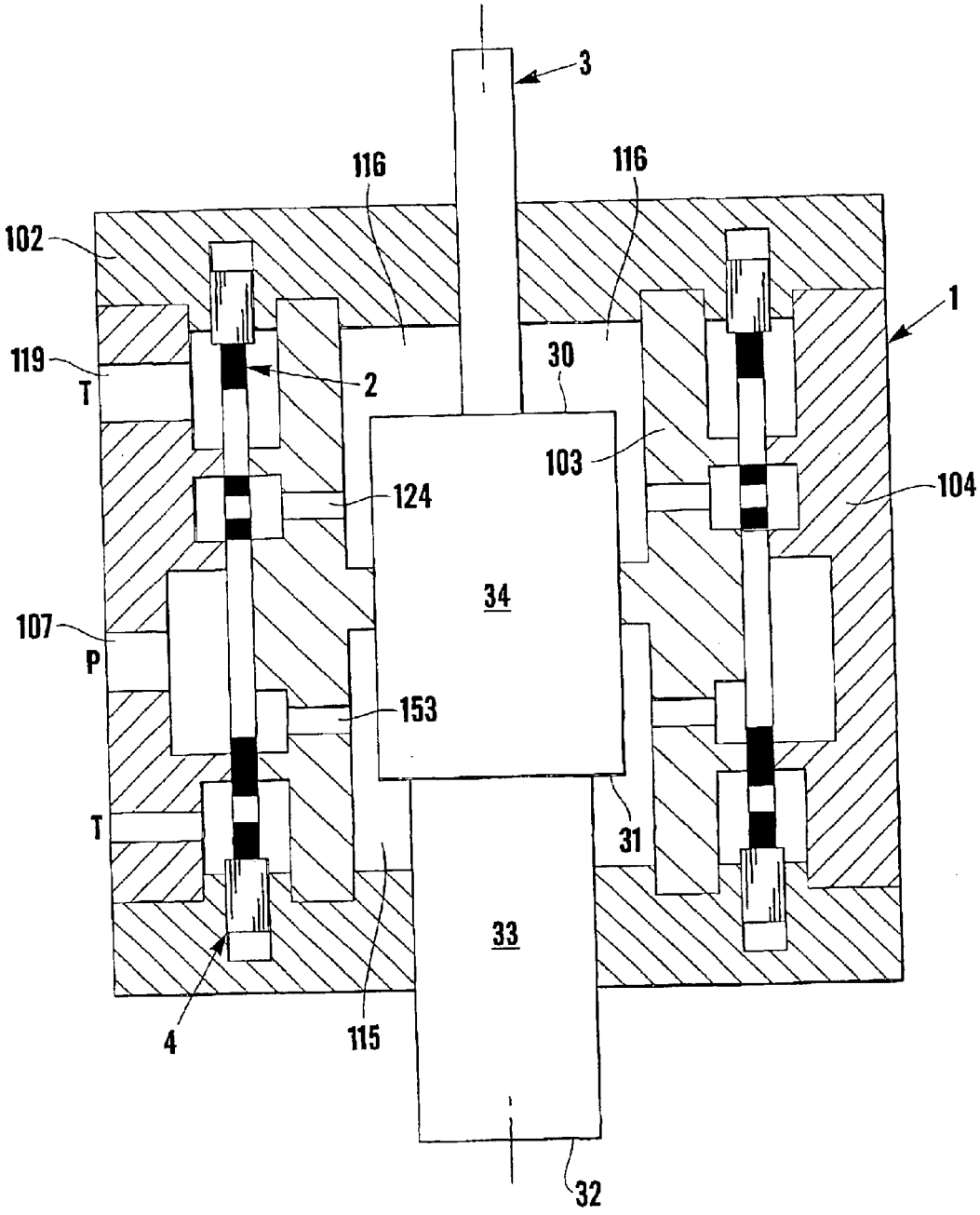
FIG. 13 shows a preferred embodiment of a hydraulic device according to the principles of the device shown in FIG. 1.

In FIG. 13 a preferred embodiment of a valve device according to the invention is shown having the hydraulic piston 3 provided co-axially inside the valve housing 1, wherein a constant pressure is used in one pressure chamber. Unlike what is shown in FIG. 1, it is, according to this preferred embodiment, the lower chamber 115 on which a constant pressure is exerted. Said embodiment implies considerable, and in certain respects surprising, advantages in comparison with an arrangement according to FIG. 1. The principles of the design of the valve housing 1, and the valve body 2 are essentially the same as described above and will therefore not be described in detail with reference to this figure. On the other hand, the hydraulic piston 3 is designed in a different way, as the upper, annular, upwardly facing surface 30 is essentially larger than the annular surface 31 facing in the opposite direction. The hydraulic piston is provided inside the valve housing 1, so that the smaller surface 31 is inside the lower pressure chamber 115, which via channels 153 in the inner valve seat portion 103 always communicates with the pressure inlet 107. The upper chamber 116 may through the channels 124 in the inner valve seat 103 communicate with either the pressure inlet 107 or the outlet 119 to a tank or be entirely blocked from communication, depending on the position of the valve body 2, according to the principles described above.

Figure 14:
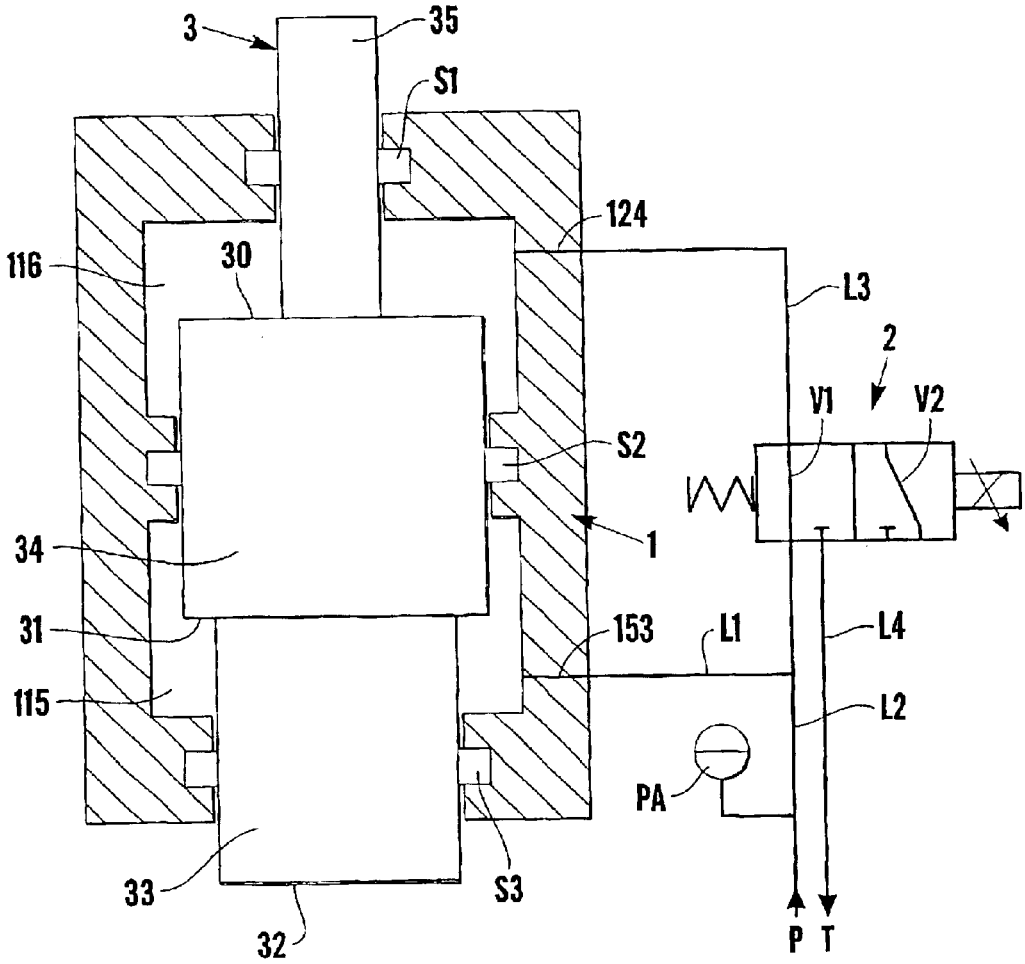
FIG. 14 illustrates a preferred function principle for a device according to FIG. 13.

In FIG. 14 the device according to FIG. 13 is schematically shown in order to be able to describe the functional principle in a simpler way. It is shown that the valve housing 1 is advantageously provided with sealings S1, S2, S3 in order to seal the pressure chambers 115, 116 from each other and also from the surroundings. Additionally, the valve body 2 is shown as a separate unit provided outside the valve housing. However, it should be realised that this is a principle drawing, which does not in any way limit the invention but that it is obvious for a man skilled in the art that an integrated valve body 2 or an externally arranged valve unit 2 may be used to utilise the advantages of a device according to this preferred embodiment. It is shown that the valve means 2 is spring influenced (the tension spring) in one direction, so that the external influence takes the position shown in FIG. 14, i.e. a position in which a conduit L3 (which may also be channels inside a valve housing) via a first connection V1 in the valve means 2 connects the channel 124 near the upper pressure chamber 116 with the pressure source P via a conduit L2 (which also partly may be channels inside the valve housing). Without any external influence, the spring will position the valve 4 so that the upper chamber is not pressurised, which is advantageous from a safety point of view. As can be seen from the figure, the pressure source P is provided with an accumulator tank PA, which ensures that the pressure in the pressure conduit L2 is always at the desired level. As shown in FIG. 14, the piston will thus be influenced by an essentially larger, downwardly directed force than an upwardly directed force, so that a rapid, downwardly directed acceleration is obtained. If the position of the valve means 2 is then changed, so that the upper conduit L3 communicates with a conduit L4 to a tank T, via V2, there will thus be an essentially lower pressure in this upper chamber 116. As there is always a fall system pressure in the lower pressure chamber 115, the hydraulic piston 3 will then be subject to an upwardly directed, accelerating force, so that the hydraulic piston will perform a return stroke. However, the acceleration of the return stroke is not as great as the percussion motion, as the upwardly facing pressure surface 30 is more than twice as large as the downwardly facing pressure surface 31. Thanks to this arrangement, the very important advantage is gained that an essentially smaller amount of oil needs to be evacuated from the lower pressure chamber 115 at a percussion motion than if an arrangement according to FIG. 1 is used. Further, the advantage is gained that no return flow to the tank exists at a stroke, as the return oil from the lower pressure chamber 115 is brought to the upper pressure chamber 116 via L1, V1, and L3. This reduces the capacity requirement of the hydraulic system and eliminates the need of large return conduits to absorb the heavy return flow, which would otherwise arise. Another, evident advantage is that the safety is drastically improved. When using a piston, which is always pressurised in the upper pressure chamber 116, there is always a risk that a stroke with high energy content could arise, if any defect appears in the device. If instead the striking piston, as shown according to the preferred embodiment of FIGS. 13 and 14, is always pressurised at the bottom side, said risk is eliminated. Further, an additional protection against malfunction is obtained by arranging a doubled number of valves, which connects the upper side of the piston with a tank. Also with reference to other aspects, an embodiment according to FIGS. 13 and 14 gives an improved safety, i.e. as the risk for diesel firing is avoided. In connection with advice according to FIG. 1 a large oil column is in fact accelerated at a stroke, which column leaves the lower chamber 115 at a high speed, when the piston is abruptly retarded at the operation, which implies that there might be a loss of oil in the lower chamber during some milliseconds resulting in a negative pressure. This may imply that components, e.g. pressure sensors, which are not manufactured for negative pressures, break down. Further, sealings which are manufactured of soft materials may be damaged and become leaky depending on the negative pressure, i.e. they are exerted to pitting damages. The negative pressure also implies that the oil releases bound air. Then, free air bubbles are formed, which then may set fire, when the pressure increases, i.e. a diesel firing effect which at best only ignites oil and sealings. With an embodiment according to FIGS. 13 and 14 all these drawbacks are eliminated, as only a very little amount of the oil column is evacuated from the chamber 115 at the striking motion. As indicated above, it is realised that this principle to achieve a rapid striking motion in connection with treatments at high speeds is not limited to a device with a valve body 2 according to the preferred embodiments described above but that this principle also may be used in connection with an external valve device of essentially any type which is rapid enough to meet the requirements within this field of application.

The invention is not limited to the above description but may be varied within the scope of the subsequent patent claims. For instance, it is realised that the principles of the function of the hydraulic device also may be achieved by a valve body which is turned/rotated instead of moved axially. Also sub-forms, e.g. a helical movement, are conceivable. At a turning motion of the valve body, it is suitably moved by an electromagnet, e.g. in the same manner as an electric engine, preferably by fixing a rotor on the sleeve, suitably a set of permanent magnets with radially directed magnetic flows, and a stator in the valve housing. Suitably, an angle sensor of any type is provided on the sleeve. Thus, it is also possible with such a solution to optionally control the position of the valve body and hence also the position and operation mode, respectively, of the hydraulic device.

What is claimed is:

1. A hydraulic device comprising a valve housing (1) with a movable valve body (2) arranged inside the valve housing, at least a hydraulic chamber (115) provided inside said valve housing (1), and at least a control mechanism (4) for the control of said movable valve body (2), wherein the valve housing (1) comprises a plurality of combined elements (102, 103, 104), at least two of said elements (103, 104) being co-axially arranged relative to each other so that an annular space (128) is formed between said two parts; the valve body (2) is substantially sleeve-shaped and arranged inside said annular space (128) in the valve housing (1); and said valve body (2) is provided with a plurality of apertures (250, 251, 252; 206, 202) to make a flow of hydraulic liquid possible in the radial direction through the valve body (2), characterised in that the valve body (2) is provided inside the valve housing (1) in such a way that it is substantially balanced with reference to the hydraulic forces acting in the radial direction; that said valve body in the vicinity of said apertures is provided with edge portions (272A, 272B) at both the inner and outer surfaces of the valve body, which edge portions (272A, 272B) interact with edge portions (103C, 104C) and channels (160, 164) provided inside the valve housing (1), so that hydraulic liquid is allowed to flow from each one of said channels and between each of said edge portions, wherein the valve body (2) is positioned inside the valve housing (1) to allow a flow of liquid to and from said hydraulic chamber (115); and that said edge portions at a second position of the valve body (2) interact in a sealing manner, so that the hydraulic liquid cannot flow to or from said hydraulic chamber (115).

2. A device according to claim 1, characterised in that the edge portion of the valve body (2) is an integrated part of at least one of said apertures.

3. A device according to claim 1, characterised in that the valve body (2) is essentially symmetrically designed with reference to a plane (P1) running centrally across the valve body.

4. A device according to claim 1, characterised in that the maximum, necessary movement of the valve body (2) within the valve housing (1) to move the valve body (2) from a shut to an open position is between 0.1 and 3% of the outer diameter (D) of the sleeve.

5. A device according to claim 1, characterised in that the movement of the valve body (2) between the shut and open positions is at least substantially performed in the axial direction with reference to the hydraulic piston (3).

6. A device according to claim 1, characterised in that an adjustment time for the valve body (2) from one end position to the other end position is below 10 msec.

7. A device according to claim 1, characterised in that a hydraulic piston provided in the hydraulic chamber with at least one outwardly facing end surface (32), wherein the hydraulic piston (3) is co-axially arranged inside the valve housing (1).

8. A device according to claim 7, characterised in that the hydraulic piston (3) comprises three co-axial, integrated units (33, 34, 35) with different outer diameters, wherein the centre portion (34) is provided with the largest diameter.

9. A device according to claim 1, characterised in that said at least one control mechanism (4) is activated in a hydraulic manner.

10. A device according to claim 9, characterised in that said control mechanism (4) comprises means (280; 290) arranged to be capable to move the valve body (2), which means are movable in apertures (122; 125) in the valve housing (1), wherein the apertures (122) essentially correspond to the shape of said means; and that said apertures (122; 125) communicate with an annular channel (123; 126) intended to be pressurised by hydraulic oil.

11. A device according to claim 10, characterised in that said means (280; 290) has a circular, outer jacket surface; and that said apertures (122; 125) are circular holes extending in the axial direction.

12. A device according to claim 1, characterised in that said at least one control mechanism is activated in a magnetic way.

13. A device according to claim 12, characterised in that said control mechanism (4) comprises at least one ferromagnetic part (41) located at the valve body and at least one electromagnet (42) provided at the valve housing.

14. A device according to claim 13, characterised in that said electromagnet (42) is cooled by hydraulic oil.

15. A device according to claim 1, characterised in that said valve housing (1) is provided with a pressure connection (107) and a tank connection (119), respectively, in one or several of its side walls.

16. A device according to claim 1, characterised in that said device is a part of a percussion/pressing means intended to perform quick percussions and to transmit heavy forces, wherein the valve body (2) has a minimum diameter between 3 and 500 mm.

17. A device according to claim 1, characterised in that at least one of said edge portions is provided with symmetrically arranged recesses, which, at a little movement of the valve body (2) from its shut position, allows a minor flow to occur in the radial direction through the valve body (2).

18. A device according to claim 1, characterised in that the length of the edge portions and hence the total opening area may vary by varying the position of the valve body in the rotating direction.

19. A device according to claim 1, characterised in that the valve body (2) is positioned by the hydraulic pressure acting on annular surfaces (Ai, Ay), wherein the hydraulic fluid to at least one of said surfaces is controlled by a valve slide (41A) provided in the valve body (2) and working according to the known principle for copying valves, so that the surrounding valve body slavishly follows said valve slide (41A), which in turn is positioned by a double-acting electromagnet.

20. A device according to claim 7, characterised in that the hydraulic piston (3) is provided with at least two annular, force-transmitting surfaces (30, 31), which are opposite to each other, wherein the upper annular surface (30) is larger than the other one.

21. A device according to claim 1, characterised in that said valve housing (1) is provided with two separate hydraulic chambers (115, 116).

* * * * *